United States Patent [19]

Nakanishi et al.

[11] Patent Number: 4,687,320

[45] Date of Patent: Aug. 18, 1987

[54] CONTROL SYSTEM FOR A COPIER

[75] Inventors: Yasushi Nakanishi, Yamatokoriyama; Akihiko Taniguchi, Nara, both of Japan

[73] Assignee: Sharp Kabushiki Kaisha, Osaka, Japan

[21] Appl. No.: 818,480

[22] Filed: Jan. 13, 1986

[30] Foreign Application Priority Data

Jan. 30, 1985 [JP] Japan ..... 60-17972

[51] Int. Cl.[4] ..... G03G 21/00; G03G 15/00

[52] U.S. Cl. ..... 355/14 R

[58] Field of Search ..... 355/3 DD, 14 R, 14 C, 355/15, 14 DD

[56] References Cited

U.S. PATENT DOCUMENTS

| | | | |
|---|---|---|---|
| 3,737,734 | 6/1973 | Nakamura et al. | 355/14 R X |
| 3,838,922 | 10/1974 | Nelson | 355/15 |
| 3,989,371 | 11/1976 | Valentine | 355/14 R |
| 4,436,414 | 3/1984 | Kamiyama et al. | 355/15 |

*Primary Examiner*—Fred L. Braun

*Attorney, Agent, or Firm*—Flehr, Hohbach, Test, Albritton & Herbert

[57] ABSTRACT

A control system for an electrophotographic copier includes a detector switch for outputting a warning signal when it detects that a container for discarded toner for the copier becomes full and a device for stopping the copying operation only after a specified number of copies are produced after the container became full and the aforementioned warning signal has been outputted.

6 Claims, 4 Drawing Figures

CONTROL SYSTEM FOR A COPIER

This invention relates to a control system which serves to stop the operation of an electrophotographic copier after its container for discarded toner becomes full.

An electrophotographic copier is a device which functions to develop a latent electrostatic image formed on a photosensitive body by means of a toner of resin powder and to produce copies by transferring this toner image onto a copy paper. During its transferring process, the toner which is placed on the photosensitive body is not entirely transferred onto the copy paper but a portion thereof remains on the photosensitive body even after the transferring process and there is provided a cleaner unit which serves to remove such remaining toner in preparation for the next copying process, throwing away such residual toner into a container as a waste material to be discarded. Since a waste is generated after each copying process, the amount of discarded toner accumulated in the container increases and the limit of the container's capacity is eventually reached. If the copying is continued in this condition, the discarded toner will flow into the copier body, not only thereby making the copier body dirty but also causing malfunctions in the optical system and adversely affecting the quality of the produced copies. For this reason, the container for discarded toner is generally provided with a sensor which is switched on when the container becomes filled and a control system is programmed to output a warning and to stop the copier operation when the ON-condition of the sensor is detected.

The conventional control system for a copier is adapted to terminate the copier operation as soon as it detects the sensor to be in the ON-condition and outputs a signal to urge the user to empty the container or otherwise take care of the situation. Such a control system is inconvenient when the container becomes full while the user is in a hurry to effect copying or in the midst of a continuous operation because the copying cannot be resumed under such conditions until the discarded toner is disposed of.

It is therefore an object of the present invention in view of the inconvenience described above to provide a control system for an electrophotographic copier which enables the user to make a predetermined number of copies even after the container for discarded toner becomes full.

The above and other objects of the present invention are achieved by providing a control system for a copier which comprises a detecting means for detecting that the copier's container for discarded toner has become full and a stopping means which serves to allow a predetermined number of copies to be made even after the aforementioned container is found to be full before stopping the copier from getting ready for further copying.

With a control system as described above, the user can make a specified number of copies even if the container for discarded toner has become full. Thus, inconvenience to the user can be minimized when there is an urgent copying job to be completed because the operation of the copier need not be interrupted in such a situation. If a warning device is provided in addition by means of which the user can be informed that the container for discarded toner has become full, the user may be able to dispose of the discarded toner while the copier is operating, thereby minimizing the time interval during which the copying operation must be interrupted.

The accompanying drawings, which are incorporated in and form a part of the specification, illustrate an embodiment of the present invention and, together with the description, serve to explain the principles of the invention.

Figure 1:
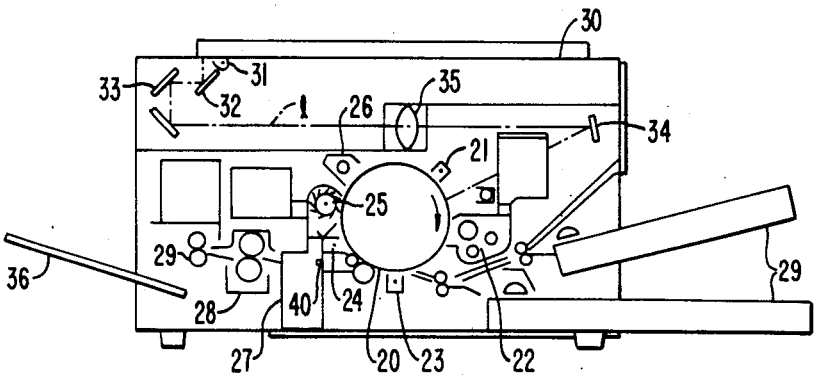
FIG. 1 is a schematic drawing which shows the structure of a principal part of an electrophotographic copier having a control system embodying the present invention.

Reference being made to FIG. 1 which schematically shows the principal parts of a copier with a control system embodying the present invention, numeral 20 indicates a photosensitive drum surrounded by a charger 21, a developing means 22, a transferring means 23, a discharging means 24, a cleaner means 25, and a discharge lamp 26. A light path l is formed between the charger 21 and the developing means 22 by means of mirrors 32, 33 and 34 and a lens 35 from a document to be copied which is placed on a supporting table 30 to the photosensitive drum 20. The cleaner means 25 is provided with a container 27 for discarded toner, equipped with a sensor 40 for detecting that the container 27 has become full. Below the table 30, there is a lamp 31 which is adapted to move with the mirror 32 during a copying process along the lower surface of the table 30. On the right-hand (with respect to FIG. 1) side surface of the copier, there are paper cassettes 29 from which copy paper is supplied to the copier. During a copying process, a toner image formed on the photosensitive drum 20 is transferred by the transferring means 23 onto the paper fed from one of these cassettes 29. The portion of the toner which has not been transferred onto the copy paper during each transfer process is removed from the photosensitive drum 20 by the cleaner means 25 and thrown into the container 27 for discarded toner. As the copying operation is repeated many times, the amount of toner accumulated inside the container 27 increases and when it becomes full, the sensor 40 is switched on and this condition of the container 27 is reported to the control system (not shown in FIG. 1). The copy paper onto which a toner image has been transferred is taken to a fixer means 28 where the image is fixed. Thereafter, the paper is ejected onto a receiving tray 36 through rollers 29.

Figure 2:
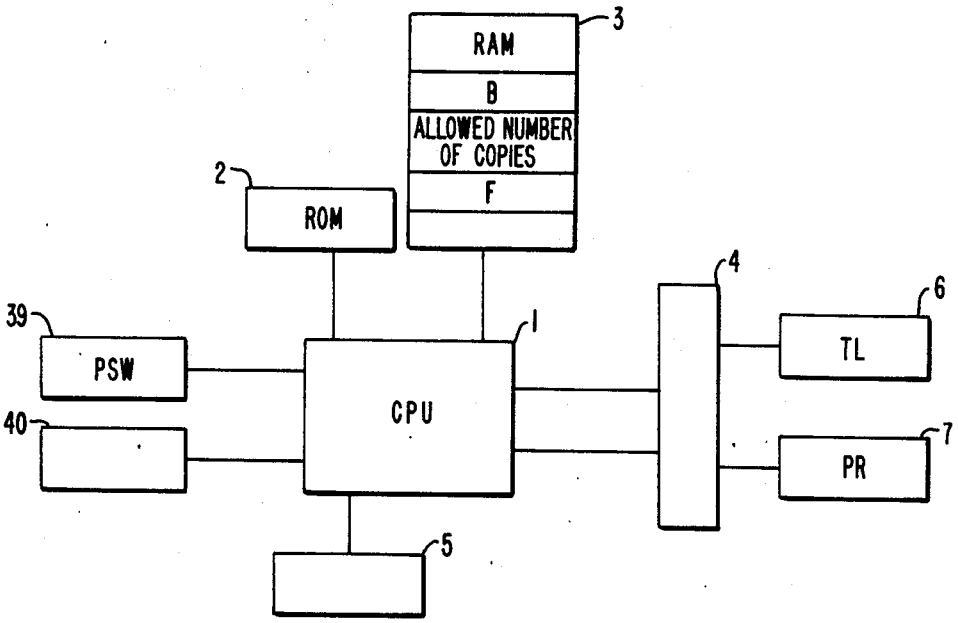
FIG. 2 is a block diagram of the copier of FIG. 1.

Reference being made next to the block diagram of FIG. 2 for the copier of FIG. 1, numeral 1 indicates a microprocessor CPU to which are connected a ROM means 2 for storing programs, a RAM means 3 for storing various data, a driver array 4 for controlling the driver means for the individual parts of the copier, a "print switch" PSW 39 for starting a copying operation, the sensor 40 and an input means 5 for other signals. A counter number B of copies produced after the sensor 40 is switched on, an area for storing the number of copies that can be produced after the sensor 40 is switched on, and a flag F indicating that the copier is operating in a continuous copying mode are included in the RAM means 3. Also connected to the driver array 4 are a warning lamp TL 6 for indicating that the container 27 for discarded toner has become full and a power relay PR 7, or a copy stopping means.

Figure 3:
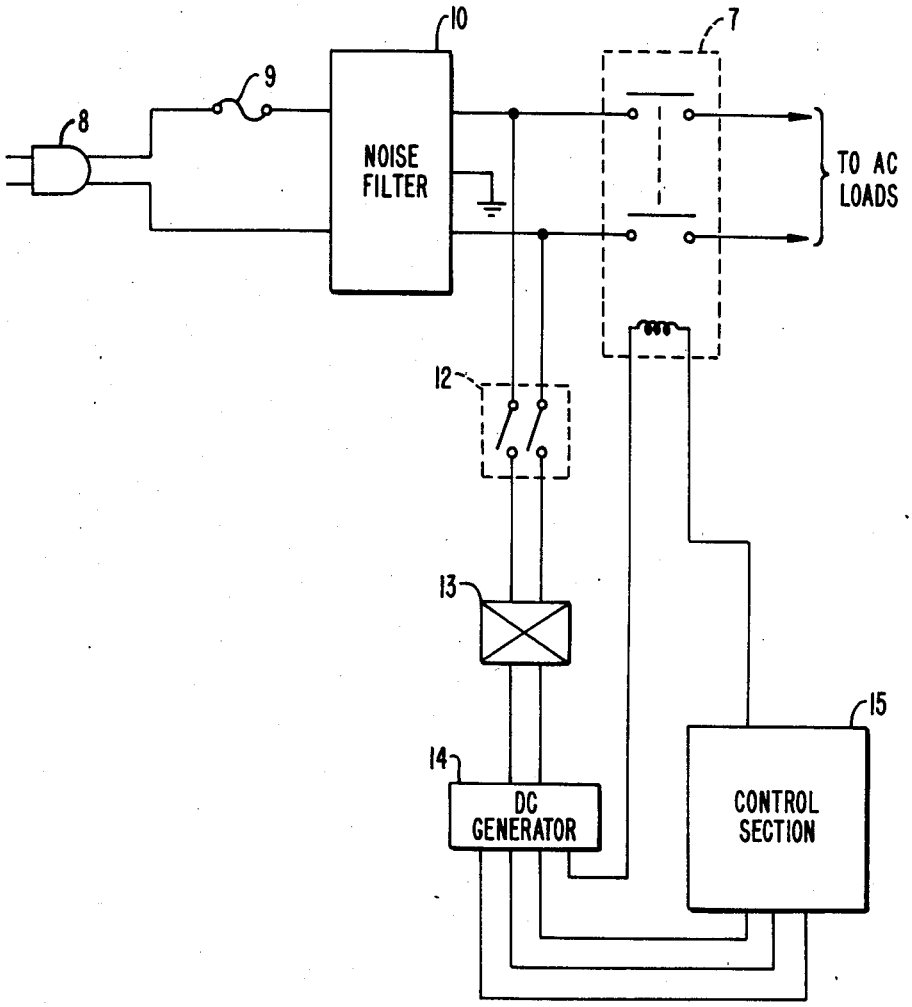
FIG. 3 is a circuit diagram for the power source section of the copier of FIG. 1.

FIG. 3 is a circuit diagram for the power source section of the copier described above. Power from a commercial source inputted through an AC plug 8, a fuse 9 and a noise filter 10 is delivered to junction points of the power relay 7 and a power switch 12. These junction points become closed when the power relay 7 is switched on and power is supplied to various load elements of the copier. The power switch 12 is connected to a transformer 13. When the power switch 12 is in the ON condition, the AC voltage from the source is reduced by the transformer 13 and inputted to a DC voltage generating means 14. The DC voltage generating means 14 not only rectifies the AC input but also uniformizes the voltage and supplies it to a control section 15. When the power switch 12 is set in the ON condition and power is supplied to the control section 15, the aforementioned microprocessor 1 starts its operation and switches the power relay 7 on through the driver array 4 if no abnormality is found is any part of the copier.

Figure 4:
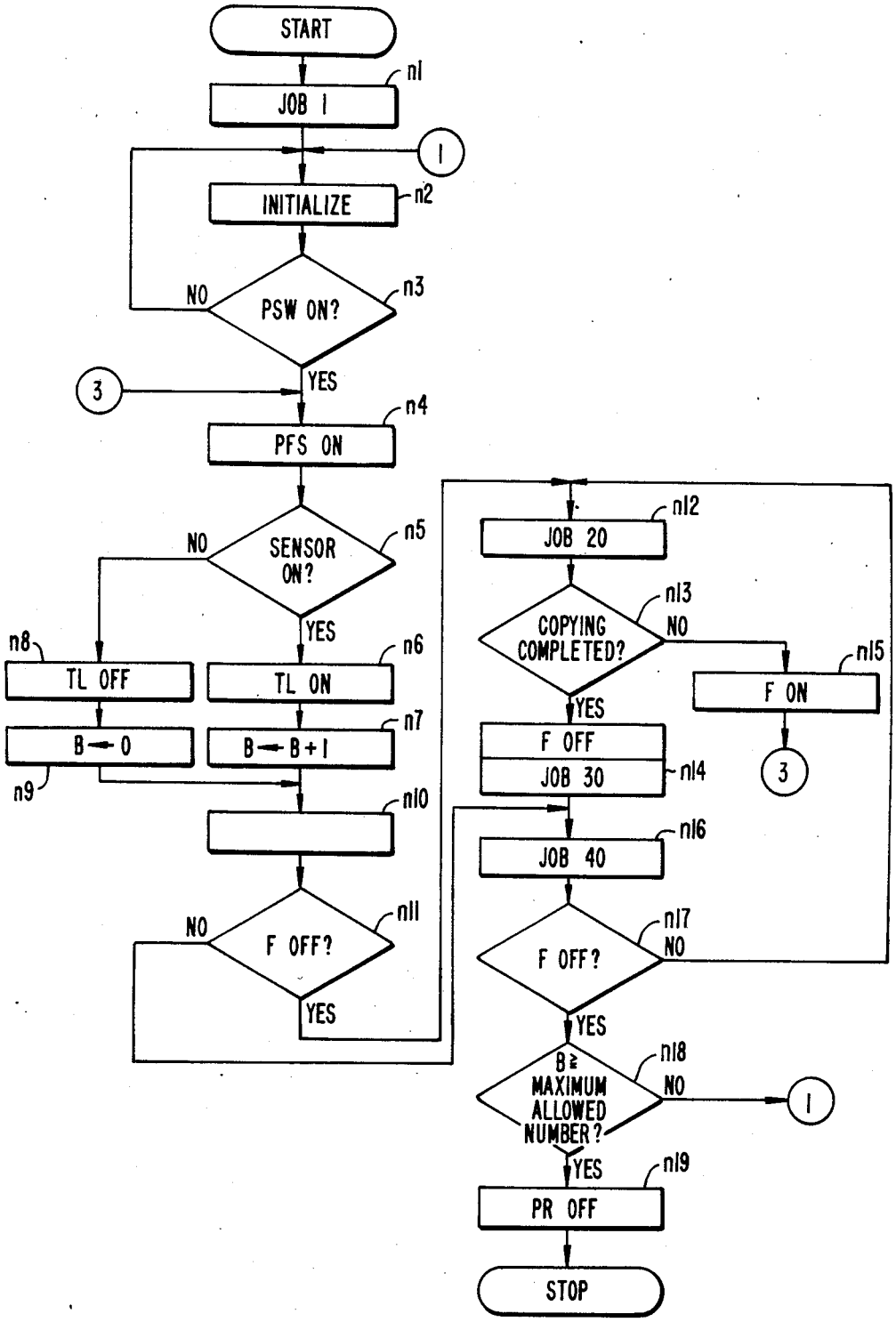
FIG. 4 is a flow chart which shows the operation of the aforementioned control system.

Operation of the aforementioned control section 15 is explained next by way of the flow chart of FIG. 4. When the power source is switched on, operations of individual parts are checked, the program is initialized and preheating is started ("JOB1" or n1). It is also ascertained at this point that the sensor 40 is in the OFF condition. After JOB1 is completed, conditions such as the number of copies to be made are set (n2) until it is determined that the print switch PSW 39 is in the ON condition (n3). When the ON condition of the print switch PSW 39 is detected (n3), a paper feed solenoid PFS is switched on and a copy paper is transported to the copier main body (n4). Next, the condition of the sensor 40 is examined (n5). If it is ON, it is concluded that the container 27 for discarded toner is full, and not only is the warning lamp TL 6 turned on (n6) but also 1 is added to the counter number B (n7). If the sensor 40 is found to be in the OFF condition in Step n5, on the other hand, it is concluded that there is still some room left in the container 27, and not only is the warning lamp TL 6 turned off (n8) but also the counter B is cleared (n9). In Step n10, copying is carried out by illuminating the document to be copied and developing the photosensitive drum (JOB10). Thereafter, the flag F is examined (n11). If the flag F is ON, it means that the operation is in the continuous copying mode. Thus, the copy paper from the immediately preceding copying cycle is ejected (JOB40 or n16) first and operations for the subsequent copying cycle are resumed. If the flag F is found to be in the OFF condition, this means that only a single copy is to be produced and the program proceeds directly to JOB20 (n12) which includes the transferring of toner image from the photosensitive drum onto a sheet of copy paper and the fixing of the toner image on the paper. It is then determined in Step n13 if the desired number set in Step n2 of copies have been produced. If the answer is NO, the flag F is switched on (n15) and the program returns to Step n4, starting the next cycle of copying from the step of feeding paper. If the copying is found to have been completed on the desired number of sheets (n13), the program proceeds to Step n14, switching off the flag F and performing the end processes of a copying cycle such as stopping the rotation of the photosensitive drum (JOB13). The processed copy paper is subsequently ejected (JOB40) in Step 16 and the flag F is examined again (n17). If the flag F is in the OFF condition, the counter number B after the container for discarded toner became full is compared with the maximum allowed number of sheets initially set in the program (n18). If the counter number B is found to have reached the maximum allowed number, the power relay 7 is switched off (n19), thereby terminating the supply of power to the AC loads and ending the process. If the counter number B is less than the maximum allowed number, the program returns to Step n2 and waits until the print switch PSW 39 is subsequently switched on.

The foregoing description of a preferred embodiment of the invention has been presented for purposes of illustration and description. It is not intended to be exhaustive or to limit the invention to the precise form disclosed, and obviously many modifications and variations are possible in light of the above teaching. For example, the microprocessor 1 may be programmed more simply than depicted by way of the flow chart of FIG. 4. According to the flow chart of FIG. 4, copying is resumed in the case of an operation in the continuous copying mode until the entire job is completed while, in other situations, only up to an inputted maximum number of copies can be produced after the container for discarded toner becomes full. The microprocessor 1 may be programmed such that only one of the above criteria may be depended upon to stop the operation of the copier. Modifications and variations that may be apparent to a person skilled in the art are intended to be within the scope of the present invention.

What is claimed is:

1. A control system for an electrophotographic copier comprising a detecting means for detecting that a container for discarded toner became full, and a stopping means for stopping preparations for the operation of said copier after a selectably specified number of copies are produced by said copier after said detecting means detects that said container became full.

2. The control system of claim 1 wherein said specified number is equal to the remaining number of copies to be made in a continuous copying mode of operation of said copier.

3. The control system of claim 1 wherein said stopping means serves to stop the operation of said copier by disconnecting a power source from AC loads of said copier.

4. The control system of claim 2 wherein said stopping means serves to stop the operation of said copier by disconnecting a power source from AC loads of said copier.

5. The control system of claim 3 wherein said stopping means stops the operation of said copier by opening a power relay connected in series to said power source.

6. The control system of claim 4 wherein said stopping means stops the operation of said copier by opening a power relay connected in series to said power source.

* * * * *